US007532130B2

(12) United States Patent
Curtis

(10) Patent No.: US 7,532,130 B2
(45) Date of Patent: May 12, 2009

(54) METHOD AND SYSTEM FOR SENDING TELEMETRIC INFORMATION BETWEEN VEHICLES

(75) Inventor: Bryce Allen Curtis, Round Rock, TX (US)

(73) Assignee: International Business Machines Corporation, Armonk, NY (US)

( * ) Notice: Subject to any disclaimer, the term of this patent is extended or adjusted under 35 U.S.C. 154(b) by 393 days.

(21) Appl. No.: 11/382,293

(22) Filed: May 9, 2006

(65) Prior Publication Data

US 2008/0018493 A1 Jan. 24, 2008

(51) Int. Cl.
*G08G 1/00* (2006.01)

(52) U.S. Cl. ..... 340/902; 340/435; 701/300; 180/167

(58) Field of Classification Search ..... 701/70, 701/300; 340/435, 438, 902, 903; 180/167
See application file for complete search history.

(56) References Cited

U.S. PATENT DOCUMENTS

| | | | | |
|---|---|---|---|---|
| 6,985,089 | B2 * | 1/2006 | Liu et al. | 340/903 |
| 2006/0273922 | A1 * | 12/2006 | Bhogal et al. | 340/901 |
| 2007/0135980 | A1 * | 6/2007 | Plante | 701/35 |
| 2007/0168129 | A1 * | 7/2007 | Thorne | 701/301 |

OTHER PUBLICATIONS

Curtis Allen Bryce; "Method and System for Sending Events Between Vehicles", May 9, 2006.

* cited by examiner

*Primary Examiner*—Timothy Edwards, Jr.
(74) *Attorney, Agent, or Firm*—Yee & Associates, P.C.; Jill A. Poimboeuf

(57) ABSTRACT

The illustrative embodiments provide a method, system, computer program product, and computer implemented method for sending telemetric information to a plurality of vehicles. A second vehicle receives the telemetric information from a first vehicle that indicates a vehicle status, wherein the vehicle status indicates an intent to change movement of the first vehicle by a user of the first vehicle. The second vehicle processes the telemetric information from the first vehicle. The second vehicle then forwards the telemetric information from the first vehicle to a set plurality of vehicles to form forwarded telemetric information.

1 Claim, 5 Drawing Sheets

400

| 410 | 420 |
|---|---|
| Vehicle Position = right in front | Vehicle ID = 123 ABC, Toyota Camry |
| Telemetric Name = brake | Value = on |
| 430 | 440 |

| 460 | 470 |
|---|---|
| Vehicle Position = two cars in front | Vehicle ID = 123 ABC, Toyota Camry |
| Telemetric Name = brake | Value = on |
| 480 | 490 |

450

METHOD AND SYSTEM FOR SENDING TELEMETRIC INFORMATION BETWEEN VEHICLES

BACKGROUND OF THE INVENTION

1. Field of the Invention

The present invention relates generally to an improved method for communicating between vehicles. Still more particularly, the present invention relates to a method, system, computer program product, and computer implemented method for sending telemetric information between vehicles.

2. Description of the Related Art

Often, users have a difficult time assessing different driving situations based on the vehicles in front of the user. In some circumstances, a user is not able to see other vehicles when following a semi-truck or a large sports utility vehicle (SUV). In other circumstances, a user in a traffic jam cannot determine the location of the accident or cause of the traffic jam. In other situations, a user just needs information about the other vehicles in front of the user to make an assessment on the next steps to take.

Currently, radar and sonar technology is used to measure the distances between vehicles. In some situations, the same technology is used to automatically slow down a vehicle in order to maintain a safe distance from a lead vehicle. Similar technology is also employed to help users gauge the distance of another vehicle during parallel parking. However, the radar and sonar technology in these instances are limited and only send communications within one vehicle. Information transmitted from other vehicles is sometimes still required for a user to make a good assessment of the driving conditions.

SUMMARY OF THE INVENTION

The illustrative embodiments provide a method, system, computer program product, and computer implemented method for sending telemetric information to a plurality of vehicles. A second vehicle receives the telemetric information from a first vehicle that indicates a vehicle status, wherein the vehicle status indicates an intent to change movement of the first vehicle by a user of the first vehicle. The second vehicle processes the telemetric information from the first vehicle. The second vehicle then forwards the telemetric information from the first vehicle to a set plurality of vehicles to form forwarded telemetric information.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
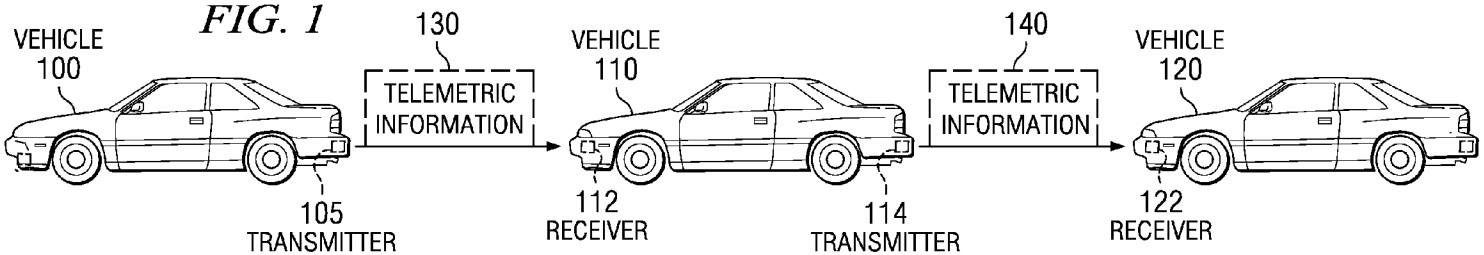
FIG. 1 illustrates a vehicle sending telemetric information to a plurality of vehicles in accordance with an illustrative embodiment.

FIG. 1 illustrates a vehicle sending telemetric information to a plurality of vehicles in accordance with an illustrative embodiment. FIG. 1 includes vehicles 100, 110, and 120. Vehicles 100, 110, and 120 may be traveling in any environment, such as a street or interstate highway. In the illustrative embodiment, vehicle 100 travels directly ahead of vehicles 110, and vehicle 110 travels ahead of vehicle 120.

Vehicle 100 includes transmitter 105. In the illustrative embodiment, transmitter 105 is disposed on the bumper of vehicle 100. However, transmitter 105 may also be disposed on the trunk, rear window, or any other location on vehicle 100. Transmitter 105 is any mechanism that can transmit a wireless communication, such as a light, transducer, antenna, or light emitting diode (LED).

Vehicle 110 includes receiver 112 and transmitter 114. In the illustrative embodiment, receiver 112 is disposed on the front bumper of vehicle 110. However, receiver 115 may also be disposed on the front hood, front window, or any other location on vehicle 110. Receiver 115 can be any mechanism that receives a wireless communication, such as a photo detector, light detector, sonic detector, or antenna. Transmitter 114 is similar to transmitter 105, and, in the illustrative embodiment, is located on the bumper of vehicle 110.

Vehicle 120 includes receiver 122. Receiver 122 is similar to receiver 112. In the illustrative embodiment, receiver 122 is disposed on the front bumper of vehicle 110.

In the illustrative embodiment, transmitter 105 sends telemetric information 130 to receiver 112, and transmitter 114 sends telemetric information 140 to vehicle 120. Telemetrics is the use of telecommunications to send, receive, and store information. Commonly, telemetrics refers to the use of global positioning systems within a vehicle. However, in the illustrative embodiment, telemetric information 130 and 140 also encompasses other information transmitted from a vehicle, such as messages regarding the engine overheating or low tire pressure, communications regarding whether the vehicle is making a right or left turn, or requests for opening a networking gaming session with other vehicles.

Any form of wireless communication, such as an infrared signal, a laser signal, a sonic signal, a radio transmission, or a wi-fi communication may transmit telemetric information 130 and 140. In the illustrative embodiment, telemetric information 130 and 140 is a communication indicating the intent of a user to change the movement of vehicle 100.

A vehicle status triggers the intent of a user to change the movement of vehicle 100. For example, a vehicle status may be the user braking, turning the steering wheel at the speed limit, or turning the steering wheel while vehicle 100 is slowing down. Thus, the corresponding change in movement of vehicle 100 may be vehicle 100 slowing down, changing lanes, or turning. Telemetric information 130 communicates the change in movement of vehicle 100 to vehicle 110.

However, in certain situations, the intent to change the movement of vehicle 100 may also need to be communicated to vehicle 130. For example, if a user in vehicle 120 cannot see vehicle 100 because vehicle 110 blocks the view of vehicle 120, the user of vehicle 120 may wish to know if vehicle 100 suddenly stops or is suddenly faced with another bad driving condition. The knowledge of the intent to change the movement of vehicle 100 may help the user of vehicle 120 respond appropriately to the presented situation.

In the illustrative embodiment, transmitter 114 sends telemetric information 140 to receiver 122. In the illustrative embodiment, telemetric information 140 is the same as telemetric information 130. Thus, telemetric information 140 communicates the intent of the user in vehicle 100 to change the movement of vehicle 100. In the illustrative embodiment, vehicle 110 acts as the medium for transmitting the communication from vehicle 100 to vehicle 120. Thus, in use, receiver 112 receives telemetric information 130. Then, vehicle 110 processes telemetric information 130 and transmits the communication as telemetric information 140 to vehicle 120.

In an alternative embodiment, telemetric information 130 and 140 may communicate different information. For example, telemetric information 130 may only include information related to the intent of the user in vehicle 100 to change the movement of vehicle 100. Telemetric information 140 may then only include information related to the intent of the user in vehicle 110 to change the movement of vehicle 100. In another embodiment, telemetric information 140 may include information related to the intent of the users in both vehicles 100 and 110. Additionally, telemetric information 130 and 140 may also include more or less information from a plurality of vehicles.

The illustrative embodiment also allows for telemetric information 130 and 140 to be communicated to a set plurality of vehicles. A set plurality of vehicles is one or more vehicles other than vehicles 100 or 110. Thus, in the illustrative embodiment, vehicle 120 plus any additionally vehicles subsequent to vehicle 120 are included in the set of plurality of vehicles. Thus, in use, vehicle 105 sends telemetric information 130 to vehicle 110. Vehicle 110 then forwards telemetric information 140 to vehicle 120. Vehicle 120 may then pass telemetric information 140 or other telemetric information to a subsequent vehicle. The subsequent vehicle may also pass the same information on to another vehicle, and that vehicle may pass the same information on to another vehicle. To implement the presented embodiment, all vehicles will have a receiver and a transmitter, like vehicle 110. Additionally, each vehicle that is receiving and transmitting the telemetric information would use a process similar to the one described in vehicle 110 to receive and transmit the telemetric information.

The illustrative embodiment also allows for telemetric information to be sent via an intermediate medium, such as a network tower. In such an embodiment, vehicles 105 and 110 would transmit corresponding telemetric information 130 and 140 to a network tower. The network tower would then forward telemetric information 130 and 140 to the appropriate vehicle.

Figure 2:
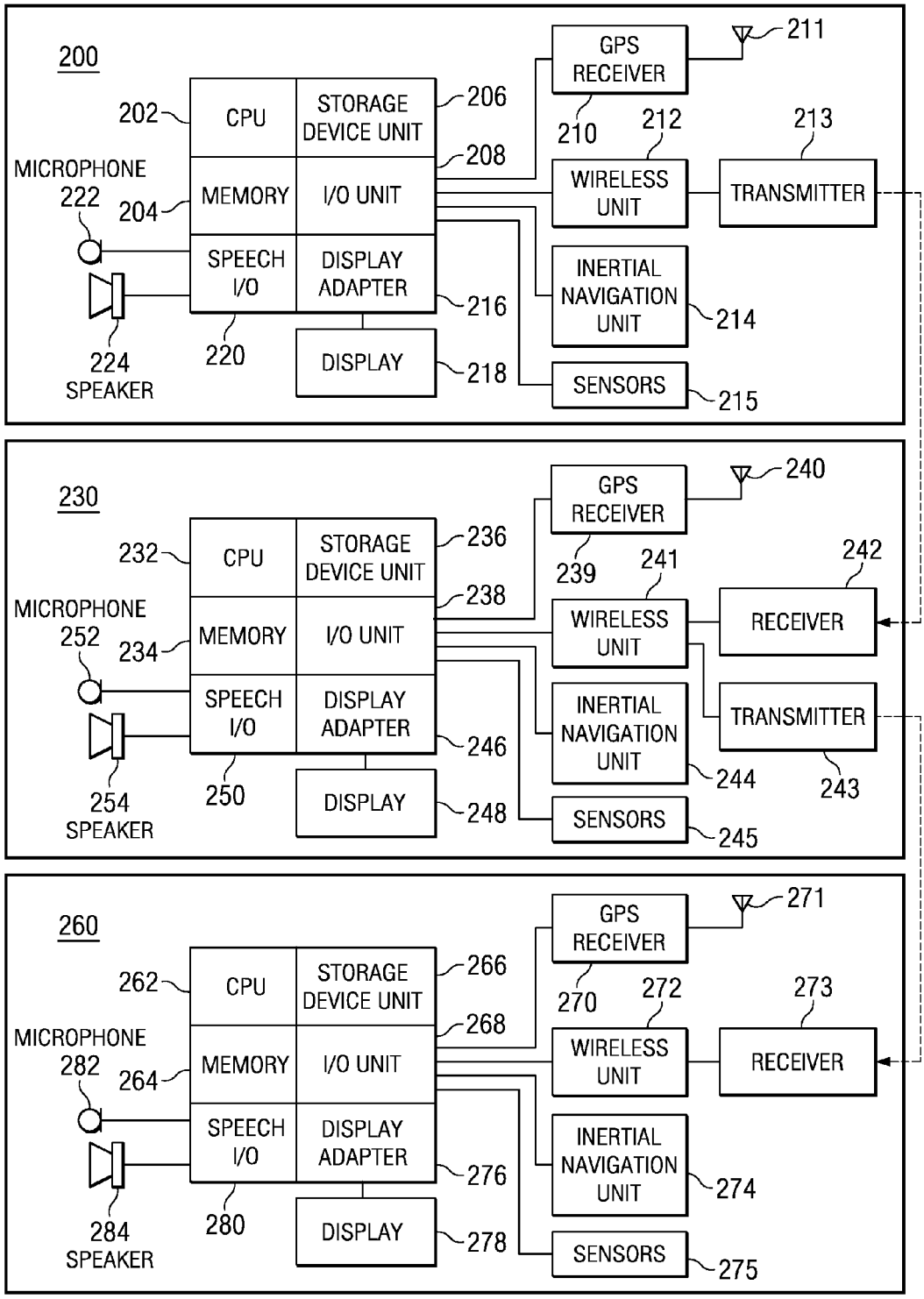
FIG. 2 is a block diagram of three vehicle computing platforms in accordance with an illustrative embodiment.

FIG. 2 is a block diagram of three vehicle computing platforms in accordance with an illustrative embodiment. FIG. 2 includes computing platforms 200, 230, and 260. Computing platforms 200, 230, and 260 each reside in a separate vehicle. In the illustrative embodiment, computing platforms 200, 230, and 260 are residing in vehicles that are traveling directly behind each other, such as the configuration of vehicles 100, 110, and 120 of FIG. 1.

Computing platform 200 is located within a vehicle, such as vehicle 100 of FIG. 1. Computing platform 200 includes a CPU 202, which may be an embedded processor or processor such as a Pentium® processor from Intel Corporation (Pentium® is a trademark of Intel Corporation). Computing platform 200 also includes memory 204, which may take the form of random access memory (RAM) and/or read only memory (ROM).

Computing platform 200 contains storage device unit 206. Storage device unit 206 may contain one or more storage devices, such as, for example, a hard disk drive, a flash memory, a DVD drive, or a floppy disk. Vehicle computing platform 200 also includes input/output (I/O) unit 208, which provides connections to various I/O devices. In this embodiment, GPS receiver 210 is included within vehicle computing system 200 and receives signals through antenna 211. Wireless unit 212 provides for two-way communications between computing platform 200 and computing platform 230. Communications are provided through transmitter 213. In addition, inertial navigation unit 214 is connected to I/O unit 208. Inertial navigation unit 214 is employed for navigation when GPS receiver 210 is unable to receive a usable signal or is otherwise inoperable.

A multitude of different sensors 215 also are connected to I/O unit 208. These sensors may include, sensors that detect speed, unusually high acceleration forces, airbag deployment, extensive speed up and slow down cycles, dropping out of cruise control, brake use, anti-lock brake occurrences, traction control use, windshield wiper use, turning on or off of lights for the automobile, and outside light levels. In addition, sensors 215 may include sensors for detecting steering wheel movement, temperature, the state of door locks, and the state of windows. In other words, almost any condition or parameter about or around an automobile may be detected through the use of sensors 215.

Computing platform 200 also includes a display adapter 216, which is connected to display 218. In the depicted example, this display is a touch screen display. Alternatively or in addition to a touch screen display, display 218 also may employ a heads-up display on the dashboard, a heads-up display projected onto the windshield of the vehicle, or a separate unit within the vehicle. Computing platform 200 also includes a microphone 222 and a speaker 224 to provide a user with an ability to enter commands and receive responses through speech I/O 220 without having to divert the user's attention away from the road, or without the user having to remove the user's hands from the steering wheel.

Computing platform 230 is similar to computing platform 200. Computing platform 230 is located within another vehicle, such as vehicle 110 of FIG. 1. Computing platform 230 includes a CPU 232, memory 234, storage device unit 236, and input/output (I/O) unit 238. In this embodiment, GPS receiver 239 is included within vehicle computing system 230 and receives signals through antenna 240. Wireless unit 241 provides for two-way communications between computing platform 230 and computing platforms 200 and 260. Communications to computer platform 200 are provided through receiver 242. Communications to computer platform 260 are provided through transmitter 243. In addition, inertial navigation unit 244 is connected to I/O unit 238. Inertial navigation unit 244 is employed for navigation when GPS receiver 239 is unable to receive a usable signal or is otherwise inoperable. A multitude of different sensors 245 also are connected to I/O unit 238. Computing platform 230 also includes display adapter 246, which is connected to display 248. Computing platform 230 also includes microphone 252 and speaker 254 to provide a user with an ability to enter commands and receive responses through speech I/O 250 without having to divert the user's attention away from the road, or without the user having to remove the user's hands from the steering wheel.

Computing platform 260 is similar to computing platforms 200 and 230. Computing platform 260 is located within another vehicle, such as vehicle 120 of FIG. 1. Computing platform 260 includes a CPU 262, memory 264, storage device unit 266, and input/output (I/O) unit 268. In this embodiment, GPS receiver 270 is included within vehicle computing system 260 and receives signals through antenna 271. Wireless unit 272 provides for two-way communications between computing platforms 260 and 230. Communications are provided through receiver 273. In addition, inertial navigation unit 274 is connected to I/O unit 268. Inertial navigation unit 274 is employed for navigation when GPS receiver 270 is unable to receive a usable signal or is otherwise inoperable. A multitude of different sensors 275 also are connected to I/O unit 268. Computing platform 260 also includes a display adapter 276, which is connected to display 278. Computing platform 260 also includes microphone 282 and speaker 284 to provide a user with an ability to enter commands and receive responses through speech I/O 280 without having to divert the user's attention away from the road, or without the user having to remove the user's hands from the steering wheel.

In use, sensors 215 detect a vehicle status within the vehicle. Sensors 215 then send the vehicle status to CPU 202. An algorithm used to process the vehicle status is located in memory 204. CPU 202 uses the algorithm to determine whether another vehicle should know of the vehicle status. To make the determination, CPU 202 compares the vehicle status against a predetermined list. The predetermined list indicates whether another vehicle should know of the vehicle status. The predetermined list is determined by the user of the first vehicle, the manufacturer of the vehicle, a standards body, or the manufacturer of computer platforms 200, 230, and 260. Vehicle statuses that may be included on the predetermined list are the application of the brake, the turning of the steering wheel, or the detection of a turn signal.

If CPU 202 determines that another vehicle should know of the vehicle status, CPU 202 sends the vehicle status to wireless unit 212. Wireless unit 212 translates the vehicle status into telemetric information and sends the telemetric information via transmitter 213 to receiver 242 of computing platform 230. Antenna 242 then transmits the telemetric information to wireless unit 241. Wireless unit 241 translates the telemetric information into a vehicle status and sends the vehicle status to CPU 232. CPU 232 executes an algorithm to convert the vehicle status into an alarm signal. CPU 232 then transmits the alarm signal to display 248. Display 248 indicates to the user of the present vehicle of the change of movement of the vehicle that includes computing platform 200.

CPU 232 then executes an algorithm to determine whether the vehicle status should be forwarded to another vehicle. If the vehicle status is for the present vehicle, then CPU 232 executes an algorithm to send the vehicle status to wireless unit 241. Wireless unit 241 then converts the vehicle status into telemetric information. Transmitter 243 then forwards the telemetric information to receiver 273. Receiver 273 then sends the telemetric information to wireless unit 272. Wireless unit 272 translates the telemetric information to a vehicle status and sends the vehicle status to CPU 262. CPU 262 then executes an algorithm to convert the vehicle status into an alarm signal. CPU 262 then transmits the alarm signal to display adapter 276. Display adapter 276 then sends the alarm signal to display 278. Display 278 indicates to the user of the present vehicle of the change of movement of the vehicle that includes computing platform 200.

Figure 3:
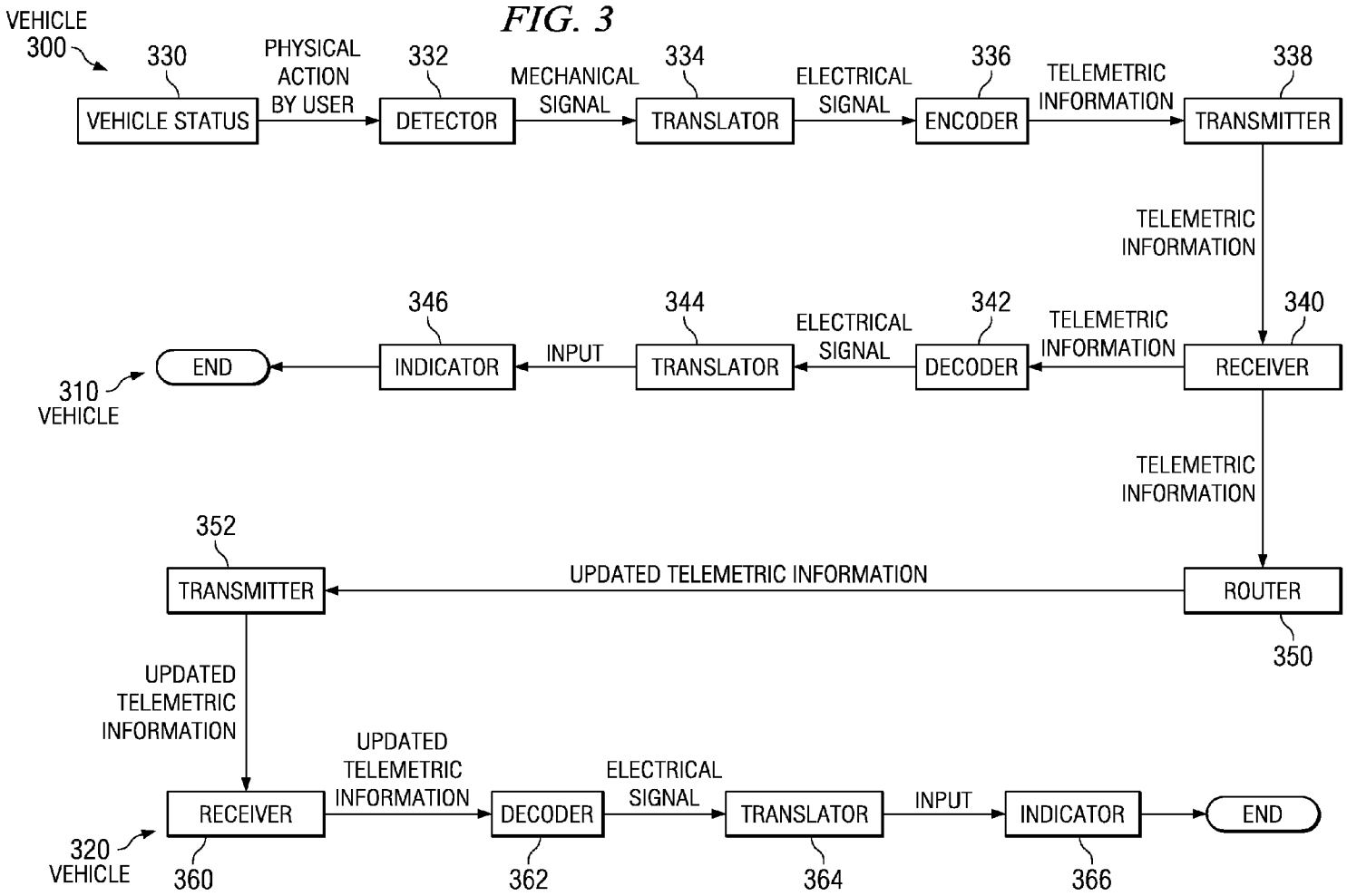
FIG. 3 shows a data flow for a first vehicle sending telemetric information to a plurality of vehicles in accordance with an illustrative embodiment.

FIG. 3 shows a data flow for a first vehicle sending telemetric information to a plurality of vehicles in accordance with an illustrative embodiment. In the illustrative embodiment, vehicle 300 transmits telemetric information to vehicle 310. Vehicle 310 then forwards the telemetric information to vehicle 320. Vehicle 300 is similar to vehicle 100 of FIG. 1, and the system illustrated for vehicle 300 is implemented in a data processing system similar to computer platform 200 of FIG. 2. Vehicle 310 is similar to vehicle 110 of FIG. 1 and the system illustrated for vehicle 310 is implemented in a data processing system similar to computer platform 230 of FIG. 2. Vehicle 320 is similar to vehicle 120 of FIG. 1, and the system illustrated for vehicle 320 is implemented in a data processing system similar to computer platform 260 of FIG. 2.

Vehicle 300 includes vehicle status 330, detector 332, translator 334, encoder 336, and transmitter 338. In the illustrative embodiment, vehicle status 330 is any physical action applied by a user to vehicle 300, such as stepping on the brakes, turning the steering wheel, turning on a turn signal, or turning on the windshield wipers.

Detector 332 is a mechanical or optical device capable of recognizing vehicle status 330. For example, if vehicle status 330 is the act of stepping on a brake, detector 332 is the brake that the user depressed. After detector 332 recognizes vehicle status 330, detector 332 sends a mechanical signal to translator 334. Translator 334 can be any electrical component, such as a photodiode, potentiometer, integrated circuit, a switch, or an inductive device. Translator 334 converts the mechanical signal into an electrical signal. Thus, for example, translator 334 converts the mechanical signal of a depressed brake into a voltage signal, which is a type of electrical signal. In the illustrative embodiment, both detector 332 and translator 334 are implemented as sensors, such as sensors 215 of FIG. 2, connected to an input/output unit, such as I/O unit 208 of FIG. 2.

After translator 335 converts vehicle status 330 into an electrical signal, translator 334 sends the electrical signal to encoder 336. Encoder 336 is an electrical component, such as an integrated circuit or a central processing unit (CPU). Encoder 336 may be implemented in a manner similar to CPU 202 of FIG. 2. Encoder 336 executes an algorithm to determine whether vehicle status 330 is a vehicle status that should be sent to another vehicle, such as vehicles 310 or 330. The list of vehicle statuses that should be sent to another vehicle may be pre-determined by the user of vehicle 300, the manufacturer of vehicle 300, a standards body, or the vendor supplying the system implemented in vehicle 300. If a determination is made that vehicle status 330 should be sent to another vehicle, then encoder 336 converts the electrical signal sent from translator 334 into an encoded message or telemetric information. If encoder 336 is a digital device, then encoder 336 converts the electrical signal into a data packet to form the telemetric information. If encoder 336 is an analog device, then encoder 336 modulates the electrical signal to form the telemetric information.

Encoder 336 then sends the telemetric information to the transmitter 338. Transmitter 338 is similar to transmitters 105 and 114 of FIG. 1. Transmitter 338 may also be implemented as input/output (I/O) unit 208, wireless unit 212, and transmitter 213 of FIG. 2. Transmitter 338 sends the telemetric information to the receiver of another vehicle. In the illustrative embodiment, transmitter 338 sends the telemetric information to receiver 340 of vehicle 310. Upon transmission, the telemetric information becomes telemetric information that encompasses vehicle status 330. Thus, in the illustrative embodiment, transmitter 338 sends telemetric information to receiver 340 of vehicle 310.

Vehicle 310 is enabled to both receive and transmit telemetric information. Thus, vehicle 310 has components to receive the telemetric information. The components include receiver 340, decoder 342, translator 344, and indicator 346. Vehicle 310 also has components to forward telemetric information. The components include router 350 and transmitter 352.

The receiving components of vehicle 310 are similar to the components of vehicle 310, except the receiving components function in a manner opposite to the corresponding components in vehicle 300. Receiver 340 is similar to receiver 112 and 122 of FIG. 1. Receiver 350 may also be implemented as input/output (I/O) unit 238, wireless unit 241, and receiver 242 of FIG. 2. Receiver 340 receives the telemetric information from vehicle 300 and either converts or demodulates the telemetric information. Receiver 340 then sends the telemetric information to decoder 342.

Decoder 342 functions similarly to encoder 336, except that decoder 342 converts telemetric information into an electrical signal. Decoder 355 is an electrical component, such as an integrated circuit or a central processing unit (CPU). Decoder 342 may be implemented in a manner similar to CPU 252 of FIG. 2. Decoder 342 determines whether the vehicle status from vehicle 300 should be communicated to the user of vehicle 310. The list of vehicle statuses that should be communicated to the user of vehicle 310 may be pre-determined by the user of vehicle 310, the manufacturer of vehicle 310, a standards body, or the vendor supplying the system implemented in vehicle 310.

If the decoder determines that that vehicle status 330 should be sent to the user of vehicle 310, decoder 342 sends the electrical signal to translator 344. Translator 344 is similar to translator 334, except that translator 344 converts the electrical signal to an appropriate input for indicator 346. Indicator 346 may be a visual, audio, or tactile indicator. Therefore, depending on the type of indicator, translator 344 converts electrical signal to an optical, audio, or mechanical input.

Indicator 346 informs the user of vehicle 310 of a vehicle status in vehicle 300. In other words, indicator 346 communicates vehicle status 330 which indicates that the user of vehicle 300 intends on changing the movement of vehicle 300. Indicator 346 may be a visual, audio, or tactile alarm. For example, a visual indicator may be a flashing light on the dashboard of vehicle 310 or a textual message on an on-board computer system within vehicle 310. An audio indicator may be the sounding of the horn or other audio signal within vehicle 310. A tactile indicator may be the steering wheel vibrating.

The illustrative embodiment provides that multiple indicators may be used simultaneously or to indicate different vehicle status. The illustrative embodiment also allows for a user to configure the type of indicator to be used for a particular vehicle status. For example, a user may designate a flashing light on the dashboard of vehicle 310 to indicate that the user has stepped on the brakes in vehicle 300. The user of vehicle 310 may then designate the vibration of steering wheel to indicate a sudden left or right turn by vehicle 300. An algorithm located within the memory of the data processing system within vehicle 310 enables the user to configure the indicators. An algorithm within decoder 342 determines which indicator matches which vehicle status.

Vehicle 310 is also enabled to forward vehicle status 330 to vehicle 320. Vehicle 310 includes router 350 and transmitter 352. Router 350 is a mechanism for changing and forwarding the telemetric information. Router 350 receives a copy of the telemetric information from receiver 340. When the telemetric information is received, the telemetric information contains information pertinent to vehicle 300 only. For example, the telemetric information includes information associated with the vehicle position of vehicle 300. With respect to vehicle 310, vehicle 300 is directly in front of vehicle 310. However, vehicle 300 is two cars in front of vehicle 320. Therefore, when the telemetric information is forwarded to vehicle 320, the vehicle position may need to be updated to reflect the position of vehicle 300 relative to vehicle 320. Additionally, another vehicle status by the user of vehicle 310 may need to be communicated to vehicle 320. Therefore, vehicle 310 will proceed through a process similar to the process described for vehicle 300. The vehicle status will also be included in the telemetric information forwarded to vehicle 320. The telemetric information is not limited to the described examples. Other information may also need to be included in the telemetric information.

Therefore, router 350 receives the telemetric information from receiver 340 and updates the telemetric information. Router 350 then sends the updated telemetric information to transmitter 352. Transmitter 352 is similar to transmitter 338 of vehicle 300. Transmitter 352 then transmits the updated telemetric information to vehicle 320.

Vehicle 320 has similar to components to vehicle 310. Vehicle 310 includes receiver 360, decoder 362, translator 364, and indicator 366. Receiver 360 is similar to receiver 340 of vehicle 310. Receiver 360 is also similar to receiver 112 and 122 of FIG. 1. Receiver 360 may also be implemented as input/output (I/O) unit 268, wireless unit 272, and receiver 273 of FIG. 2. Receiver 360 receives the telemetric information from vehicle 310 and either converts or demodulates the telemetric information. Receiver 360 then sends the updated telemetric information to decoder 362.

Decoder 362 functions similarly to decoder 342 of vehicle 310. Decoder 342 may be implemented in a manner similar to CPU 262 of FIG. 2. As in vehicle 310, decoder 362 determines whether vehicle status 330 should be communicated to the user of vehicle 320. Additionally, decoder 362 determines whether the vehicle status from vehicle 310 should also be communicated to the user of vehicle 320. The list of vehicle statuses that should be communicated to the user of vehicle 320 may be pre-determined by the user of vehicle 320, the manufacturer of vehicle 320, a standards board, or the vendor supplying the system implemented in vehicle 320.

If the decoder determines that vehicle status 330 should be sent to the user of vehicle 320, decoder 362 sends the electrical signal to translator 364. Translator 364 is similar to translator 344. Translator 362 converts the electrical signal to an appropriate input for indicator 366. Indicator 366 may be a visual, audio, or tactile indicator. Therefore, depending on the type of indicator, translator 364 converts electrical signal to an optical, audio, or mechanical input. Indicator 366 informs the user of vehicle 320 of vehicle status 330 and the vehicle status of vehicle 310.

The illustrative embodiment allows for vehicle status 330 and the updated telemetric information to be forwarded to an infinite number of vehicles. Thus, vehicle 320 could also pass on the updated telemetric information to another vehicle, and that vehicle could pass the updated telemetric information on to another subsequent vehicle. The updated telemetric information will be passed on until the information is no longer pertinent to a user of a particular vehicle. The determination of whether the telemetric information is pertinent depends upon a number of factors, including but not limited to the relative distance of vehicle 300 relative to the particular vehicle, the speed of vehicle 300, and the timing of the receipt of the telemetric information. The determinative factors may be different for the user of each vehicle. The determinative factors may also be pre-programmed into the vehicle. Therefore, in use, the decoder of each vehicle may include an algorithm for determining whether the information is pertinent the user of the present vehicle. Additionally, an encoder within each vehicle will include an algorithm for determining whether the information is to be forwarded to the user of another vehicle.

The illustrative embodiments are not limited to the presented embodiments and examples. Other devices with similar functions may be used to implement the invention. A person of ordinary skill in the art will identify other mechanisms to implement the illustrative embodiment without deviating from the scope of the illustrative embodiments.

Figures 4, 5:
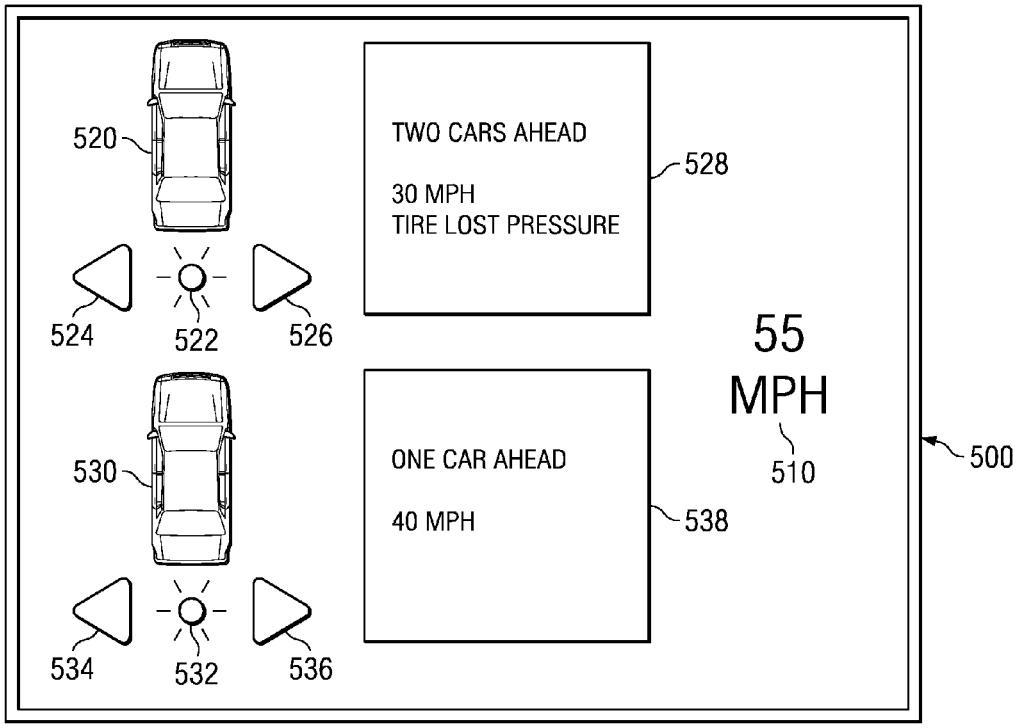
FIG. 4 illustrates an example telemetric information in accordance with an illustrative embodiment.
FIG. 5 illustrates an example heads-up display in accordance with an illustrative embodiment.

FIG. 4 illustrates an example telemetric information in accordance with an illustrative embodiment. FIG. 4 includes telemetric information 400 and 450. Telemetric information 400 is generated in a first vehicle, such as vehicle 100 of FIG. 1, and received in a second vehicle, such as vehicle 110 of FIG. 1. Telemetric information 450 is an update of telemetric information 400 and is generated by a second vehicle, such as vehicle 110 of FIG. 1, and received by a subsequent vehicle, such as vehicle 120 of FIG. 1.

Telemetric information 400 is created in an encoder and decoded by a decoder, such as encoder 336 and decoder 342 of FIG. 3. In the illustrative embodiment, telemetric information 400 is a data packet generated by a digital encoder. Telemetric information 400 may be implemented as an extensible markup language (XML) file or a software protocol.

In the illustrative embodiment, telemetric information 400 includes vehicle position 410, vehicle ID 420, telemetric name 430, and value 440. Vehicle position 410 describes the position of the vehicle transmitting telemetric information 400 relative to the vehicle receiving telemetric information 400. In the illustrative embodiment, vehicle position 410 indicates that the originating vehicle is "right in front" of the present vehicle. In other words, the transmitted telemetric information originates from a first vehicle or the vehicle directly in front of the receiving vehicle. In application, a first vehicle travels directly ahead of the receiving or the second vehicle. Thus, a first vehicle is similar to vehicle 100 of FIG. 1, and a second vehicle is similar to vehicle 110 of FIG. 1.

Vehicle ID 420 is a description identifying the vehicle originating the telemetric information. Vehicle ID 420 may be any identifying information, such as the license plate number, the make and model of the vehicle, or a vehicle identification number. In the illustrative embodiment, vehicle ID 420 includes a license plate number and the make and model of the first vehicle. Thus, the license plate number is "123 ABC," and the first vehicle is a "Toyota Camry."

Telemetric name 430 identifies a vehicle status within the first vehicle. Thus, telemetric name 430 identifies the intent of a user to change the movement of the first vehicle. Telemetric name 430 identifies a mechanical action, such as the depression of a brake or the movement of a steering wheel to the right or left. Telemetric name 430 may be identified as a number or actual text. If identified as a number, an individual vehicle status would be tied to a single number. For example, the number "1" may identify the depression of a brake, the number "2" may identify the turning of a steering wheel to the left, and the number "3" may identify the turning of a steering wheel to the right. If identified as actual text, a single phrase may be used to identify a particular vehicle status. For example, the depression of a brake may be indicated as "brake," or the turning of a steering wheel to the left may be indicated as "left turn." In the illustrative embodiment, telemetric name 430 is in a text format and identifies the depression of the brake.

Value 440 indicates the present condition of the vehicle status displayed in telemetric name 430. Thus, in the illustrative embodiment, value 440 indicates that the "brake" in the first vehicle is "on." In other words, value 440 indicates that the "brake" is presently depressed in the first vehicle. In another embodiment, if telemetric name 430 indicates "distance," then value 440 will show the distance of the first vehicle from the second vehicle, such as a distance of "30 feet."

Telemetric information 450 is an update of telemetric information 400. Telemetric information 450 is usually received by a second vehicle, such as vehicle 310, updated, and forwarded to a subsequent vehicle, such as vehicle 320 of FIG. 3. Telemetric information 400 is updated in a router and decoded by a decoder, such as router 350 and decoder 362 of FIG. 3. Telemetric information 450 is similar to telemetric information 400, except some of information regarding the first vehicle relative to the present vehicle is updated. In the illustrative embodiment, telemetric information 450 is a data packet generated by a digital encoder.

In the illustrative embodiment, telemetric information 450 includes vehicle position 460, vehicle ID 470, telemetric name 480, and value 490. Vehicle position 460 describes the position of the vehicle originating the telemetric information relative to the present vehicle. In the illustrative embodiment, vehicle position 460 indicates that the originating vehicle is "two cars in front" of the present vehicle. In application, the originating vehicle is a first vehicle, similar to vehicle 100 of FIG. 1, and the present vehicle is similar to vehicle 120 of FIG. 1.

Vehicle ID 420 is a description identifying the vehicle originating the telemetric information. Vehicle ID 470 may include the same information as vehicle ID 420. In an alternative embodiment, vehicle ID 470 may include more or less information than vehicle ID 420. In the illustrative embodiment, vehicle ID 470 includes the same information. Thus, the vehicle ID 470 indicates that the license plate number of the originating vehicle is "123 ABC," and the first vehicle is a "Toyota Camry."

Telemetric name 480 identifies a vehicle status within the first vehicle. Telemetric name 480 may reflect the same information and in the same format as telemetric name 430. In an alternative embodiment, telemetric name 480 may be represented in a number format, as opposed to the text format as illustrated in telemetric name 480. In the illustrative embodiment, telemetric name 480 reflects the same information and is in the same format as telemetric name 430. Thus, telemetric name 480 identifies the depression of the brake.

Value 490 indicates the present condition of the vehicle status displayed in telemetric name 480. In the illustrative embodiment, value 490 indicates that the brakes are presently "on" in the first vehicle. In other words, the brakes in the first vehicle are presently depressed.

The illustrative embodiments are not limited to the depicted examples. For example, telemetric information 400 or 450 may be implemented as a modulated signal from an analog encoder. Additionally, additional or less information may be included in telemetric information 400 and 450.

FIG. 5 illustrates an example heads-up display in accordance with an illustrative embodiment. Heads-up display 500 is an indicator which notifies the user of a vehicle of the vehicle status of a first vehicle. Heads-up display 500 is located on the dashboard or the windshield of a vehicle. In the illustrative embodiment, heads-up display 500 is located on the dashboard of the vehicle. Heads-up display 500 may be implemented as display 248 or 278 of FIG. 2 or indicator 346 or 366 of FIG. 3. Heads-up display 500 may also be in a set plurality of vehicles. In the illustrative embodiment, heads-up display 500 is located in a third vehicle position, such as vehicle 120 of FIG. 1.

Heads-up display 500 includes speed indicator 510, vehicle 520, and vehicle 530. Speed indicator 510 is the speed of the present vehicle. In other words, speed indicator 510 is the speedometer for vehicle that contains heads-up display 500. In the illustrative embodiment, the present vehicle is traveling at "55 mph."

Vehicles 520 and 530 represent the vehicles in front of the present vehicle. Vehicles 520 and 530 are ordered in the vehicle position relative to the present vehicle. In other words, the vehicles in heads-up display 500 are organized in the order in which the vehicle is lined up in front of the present vehicle. Thus, in the illustrative embodiment, vehicle 520 is in front of vehicle 530, and vehicle 530 is in front of the present vehicle. In other words, vehicle 520 is similar to vehicle 100 of FIG. 1, vehicle 530 is similar to vehicle 110 of FIG. 1, and the present vehicle is similar to vehicle 120 of FIG. 1. If, on the other hand, the present vehicle followed three vehicles, then three vehicles will be represented on heads-up display 500. Another vehicle will reside below vehicle 530 on heads-up display 500. Heads-up display 500 will show the number of vehicles up to the vehicle originating the telemetric information. Thus, if the originating vehicle is ten cars ahead of the present vehicle, then ten cars will be represented in heads-up display 500 in the order in which the vehicles are in front of the present vehicle.

In the illustrative embodiment, vehicle 520 represents the vehicle originating the telemetric information. Vehicle 520 includes three indicators: brake indicator 522, left turn indicator 524, and right turn indicator 526. Each indicator 522, 524, and 526 represents a particular vehicle status. In the illustrative embodiment, each indicator 522, 524, and 526 is a light. When lighted, the indicator 522, 524, and 526 illustrates the particular action taken by the user of the vehicle 520. In the illustrative embodiment, brake indicator 522 indicates that vehicle 520 is stopping, or, in other words, that the user in vehicle 520 has depressed the brake pedal. Left turn indicator 524 indicates that the first vehicle is making a left turn, or, in other words, that the user in vehicle 520 has turned on the left signal light. Likewise, right turn indicator 526 indicates that vehicle 520 is making a right turn. In the illustrative embodiment, brake indicator 522 is lighted, thereby indicating that the user of vehicle 520 has depressed the brakes.

Telemetric information box 528 provides additional information regarding vehicle 520. Telemetric information box 528 may include information specifically identifying the vehicle, such as a vehicle identification number or the make and model of the vehicle. Telemetric information box 528 may also include information regarding a condition of the vehicle, such as the speed of the vehicle or a possible reason as to why the user of vehicle 520 made a particular vehicle status. Telemetric information box 528 also may include information on the vehicle position of vehicle 520 relative to the present vehicle. Telemetric information box 528 may also include a message sent from vehicle 520 to the other vehicles. The message may be a help message and request that one of the other vehicles call for emergency assistance.

In the illustrative embodiment, information box 528 indicates that vehicle 520 is "two cars ahead" of the present vehicle, is presently traveling at "30 mph," and has lost tire pressure. Thus, based upon the information in telemetric information box 528, a user in the present vehicle may conclude that the reason that brake indicator 522 is lighted is because one of the tires in vehicle 520 has a hole.

Vehicle 530 is the vehicle directly in front of the present vehicle. Vehicle 530 is the vehicle that forwarded the telemetric information from vehicle 520 to the present vehicle. Similar to vehicle 520, vehicle 530 has three indicators: brake indicator 532, left turn indicator 534, and right turn indicator 536. In the illustrative embodiment, brake indicator 532 is lighted.

Telemetric information box 538 provides additional information regarding vehicle 530. In the illustrative embodiment, telemetric information box 538 shows that vehicle 530 is "one car ahead" of the present vehicle and is presently traveling at "40 mph." Based upon the information in telemetric information box 538, the user in the present vehicle may conclude that the reason that brake indicator 532 is lighted is because vehicle 530 is responding to slowing down of vehicle 520.

The illustrative embodiments are not limited to the depicted examples. For example, additional or less indicators may be included on heads-up display 500. The indicators may also be implemented in a form other than a light. Also, additional dashboard features, such as an odometer, gas tank gauge, or check engine light, may also be included in heads-up display 500.

Figure 6:
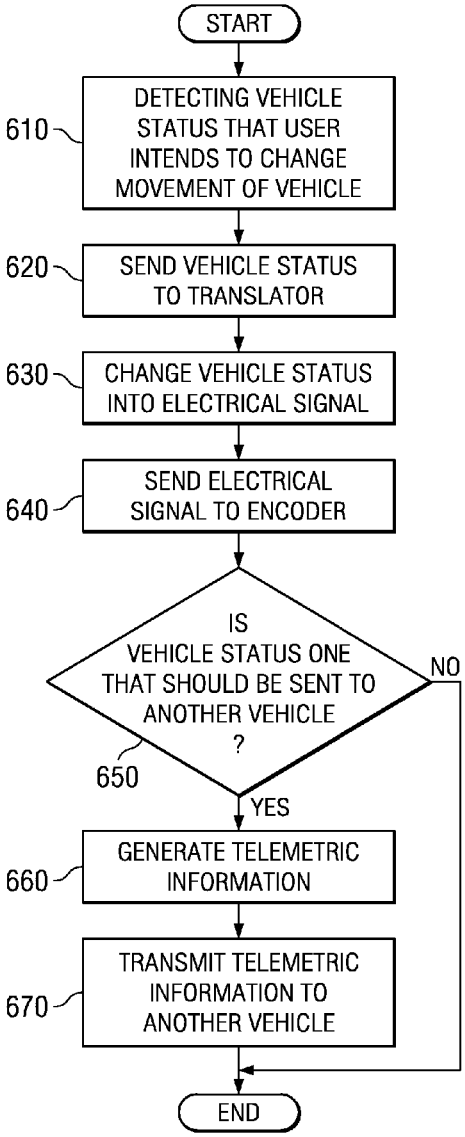
FIG. 6 is a flowchart of telemetric information being sent by a vehicle in accordance with an illustrative embodiment.

FIG. 6 is a flowchart of telemetric information being sent by a vehicle in accordance with an illustrative embodiment. FIG. 6 is executed in a vehicle originating the telemetric information, such as vehicle 100 of FIG. 1.

The process begins with a detector in the originating vehicle detecting a vehicle status that indicates that a user intends to change movement of the first vehicle (step 610). The detector then sends the vehicle status to a translator (step 620), which converts the vehicle status into an electrical signal (step 630). The electrical signal is then sent to an encoder (step 640) that determines whether the vehicle status is one that should be sent to another vehicle (step 650). To make the determination, the encoder compares the vehicle status against a predetermined list. The predetermined list indicates whether a vehicle status is pertinent. If the vehicle status is not included on the predetermined list ("no" output to step 650), the process terminates thereafter. However, if the vehicle status is included on the predetermined list ("yes" output to step 650), the encoder generates telemetric information (step 660), which is then transmitted to a second vehicle (step 670), with the process terminating thereafter.

Figure 7:
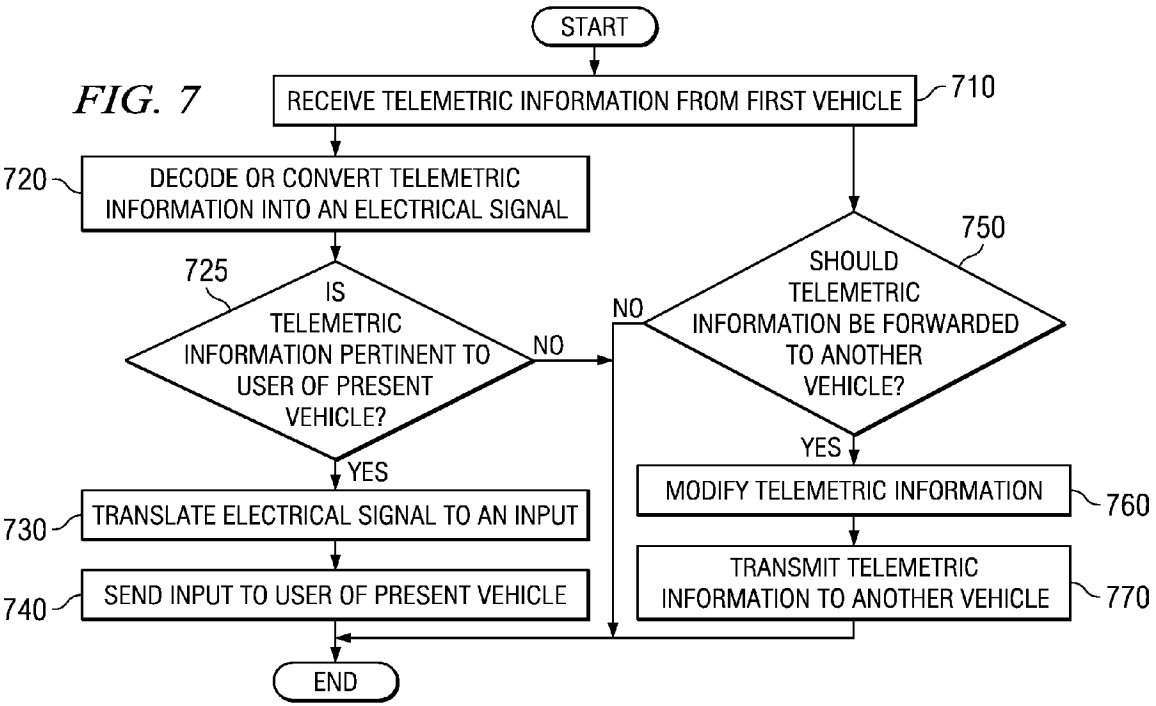
FIG. 7 is a flowchart of telemetric information being received and forwarded by a vehicle in accordance with an illustrative embodiment.

FIG. 7 is a flowchart of telemetric information being received and forwarded by a vehicle in accordance with an illustrative embodiment. FIG. 7 is executed in a second vehicle, such as vehicle 110 of FIG. 1.

The process begins with the vehicle receiving telemetric information from a first vehicle (step 710). The vehicle then decodes or converts the telemetric information to an electrical signal (step 720). A determination is then made as to whether the vehicle status encoded into the message is pertinent to the user of the second vehicle (step 725). To determine whether a vehicle status is pertinent, the decoder compares the vehicle status with a predetermined list. The predetermined list indicates whether a vehicle status is pertinent. If the vehicle status is not included on the predetermined list ("no" output step 725), the process terminates thereafter. However, if the vehicle status is included on the predetermined list ("yes" output to step 725), then the electrical signal is translated to an input (step 730), which is then sent to an indicator (step 740), with the process terminating thereafter.

Returning now to step 710, a determination is also made as to whether the telemetric information should be forwarded to another vehicle (step 750). To make the determination, the telemetric information is compared against a predetermined list of telemetric information. The predetermined list indicates whether the telemetric information should be forwarded to another vehicle. If the telemetric information is not included on the predetermined list ("no" output to step 750), the process terminates thereafter. If the information is included on the predetermined list ("yes" output to step 750), then the telemetric information is modified (step 760) and transmitted to another vehicle (step 770), with the process terminating thereafter.

Figure 8:
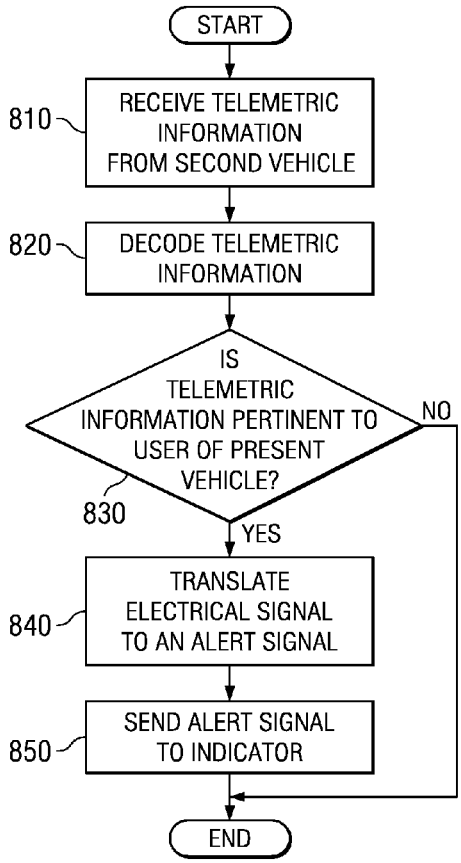
FIG. 8 is a flowchart of telemetric information being received by a vehicle in accordance with an illustrative embodiment.

FIG. 8 is a flowchart of telemetric information being received by a vehicle in accordance with an illustrative embodiment. FIG. 8 is executed in a subsequent vehicle, such as vehicle 130 of FIG. 1. The process begins with the vehicle receiving telemetric information from a second vehicle (step 810). The vehicle then decodes or converts the telemetric information to an electrical signal (step 820). A determination is then made as to whether the vehicle status encoded into the message is pertinent to the user of the present vehicle (step 830). To make the determination, the encoder compares the vehicle status against a predetermined list. The predetermined list indicates whether the vehicle status is pertinent. If the vehicle status is not included on the predetermined list ("no" output step 830), the process terminates thereafter. However, if the vehicle status is included on the predetermined list ("yes" output to step 830), the electrical signal is translated to an input (step 840), which is sent to an indicator (step 850), with the process terminating thereafter.

Thus, the illustrative embodiments provide a method system, computer program product, and computer implemented method for sending telemetric information to a plurality of vehicles. The method includes receiving the telemetric information from a first vehicle that indicates a vehicle status. The vehicle status indicates an intent to change the movement of the first vehicle by a user of the first vehicle. A second vehicle processes the telemetric information sent from the first vehicle and also forwards the telemetric information to a plurality of vehicles. In processing, the second vehicle translates the telemetric information into an alarm signal. The alarm signal is then sent and is communicated as an indicator to the user of the second vehicle. The indicator may be a visual indicator, an audio indicator, a tactile indicator, or any combination thereof. In forwarding, the second vehicle updates the telemetric information to reflect updated vehicle information. The updated telemetric information may also include information relating to a vehicle status of the first vehicle. The second vehicle then forwards the updated telemetric information to a set plurality of vehicles. The set plurality of vehicles translates the telemetric information and alerts the users of the set plurality of vehicles of the vehicle status of the first vehicle.

The ability to communicate telemetric information allows the users to assess different driving situations and respond accordingly. For example, in certain circumstances, telemetric information provides a user with information about a vehicle in which the user cannot visually see. In other circumstances, telemetric information provides a user with information about the location of a traffic accident. Moreover, telemetric information may be transmitted to alert other users of an emergency situation within a certain vehicle. If the user in the emergency situation cannot call for help, other users may be able to alert the appropriate authorities of the emergency situation.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any tangible apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A method for sending telemetric information to a plurality of vehicles, the method comprising:

receiving the telemetric information at a second vehicle from a first vehicle that indicates a vehicle status, wherein the vehicle status indicates an intent to change movement of the first vehicle by a user of the first vehicle;

processing the telemetric information from the first vehicle by the second vehicle; and forwarding the telemetric information from the first vehicle by the second vehicle to a set plurality of vehicles to form forwarded telemetric information;

wherein the step of forwarding the telemetric information by the second from the first vehicle to a set plurality of vehicles to form forwarded telemetric information comprises;

receiving the telemetric information from the first vehicle; and updating the telemetric information from the first vehicle to reflect updated vehicle position information, wherein the step of updating the telemetric information from the first vehicle to reflect updated vehicle position information comprises:

adding telemetric information about a vehicle status of the second vehicle.

* * * * *